US012344357B1

(12) United States Patent
Phillips, Jr.

(10) Patent No.: US 12,344,357 B1
(45) Date of Patent: Jul. 1, 2025

(54) SURF BOARD MODULAR PROTECTION SYSTEM AND METHOD

(71) Applicant: John Phillips, Jr., Mammoth Lakes, CA (US)

(72) Inventor: John Phillips, Jr., Mammoth Lakes, CA (US)

( * ) Notice: Subject to any disclaimer, the term of this patent is extended or adjusted under 35 U.S.C. 154(b) by 14 days.

(21) Appl. No.: 18/596,533

(22) Filed: Mar. 5, 2024

(51) Int. Cl.
*B63B 32/87* (2020.01)
*B63B 32/70* (2020.01)

(52) U.S. Cl.
CPC ..... *B63B 32/87* (2020.02); *B63B 32/70* (2020.02)

(58) Field of Classification Search
CPC ..... B63B 32/87; B63B 32/70
USPC ..... 206/315.1
See application file for complete search history.

(56) References Cited

U.S. PATENT DOCUMENTS 4,719,952 A * 1/1988 Geronimo ..... B63B 32/70 441/74
5,014,955 A * 5/1991 Thompson ..... B63B 32/83 441/74
5,163,550 A * 11/1992 Hawk ..... B63B 32/80 224/901.4
11,617,426 B2 * 4/2023 Boyles ..... A63C 11/026 220/8
2008/0302685 A1 * 12/2008 Saucedo ..... B63C 13/00 206/315.1
2009/0283436 A1 * 11/2009 Carcamo ..... B63B 32/87 206/522
2010/0025271 A1 * 2/2010 Boyles ..... F41C 33/06 224/582
2012/0118767 A1 * 5/2012 Koett ..... B63B 32/57 206/586
2014/0190851 A1 * 7/2014 Samios ..... B63B 32/87 156/60
2018/0208279 A1 * 7/2018 Soren ..... B63B 32/87

* cited by examiner

*Primary Examiner* — Jacob K Ackun
(74) *Attorney, Agent, or Firm* — Merle W Richman, III

(57) ABSTRACT

A modular, light weight, easy to install protection system configurable for surfboards having different shapes and lengths. The protection system including several modular protection sections including a modular protection system for the nose, the rocker, and the tail. Each protection section including one or more bumpers configured to rest or be seated along rails of each section. Each protection section may further including at least one securable locking element that engages the bumpers to remain desirably coupled to rails of a surfboard to be protected.

17 Claims, 6 Drawing Sheets

10A

10A

10B

40

60

50

SURF BOARD MODULAR PROTECTION SYSTEM AND METHOD

BACKGROUND

1. Field of the Invention

The invention relates generally to surfboard protection systems and in particular removable systems that may be employed to protect surfboards.

2. Description of Related Art

It may be desirable to provide an easy-to-use modular system that safely protects a surfboard, the present invention provides such a system.

3. Background of the Invention

Surfboards due to their construction and desirable low weight may be easily damaged in particular their rails during transportation.

2. SUMMARY OF THE INVENTION

The present invention provides modular, light weight, easy to install protection systems configurable for surfboards having different shapes and lengths. A protection system may include several modular protection sections including a modular protection system for the nose, the rocker, and the tail. Each protection section may include one or more bumpers configured to rest or be seated along rails of each section. Each protection section may further include at least one securable locking element that engages the bumpers to remain desirably coupled to rails of a surfboard to be protected. In an embodiment, a first end of a locking element may be securely coupled to a first bumper. The second end of the locking element may pass about a second, opposite bumper and slidably couple to the first end of the locking element. The second end of the locking element may include a first segment of a securing system. The first end of the locking element may include a second segment of a securing system. The securing system may include first and second Velcro® elements or segments.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION

Figure 1:
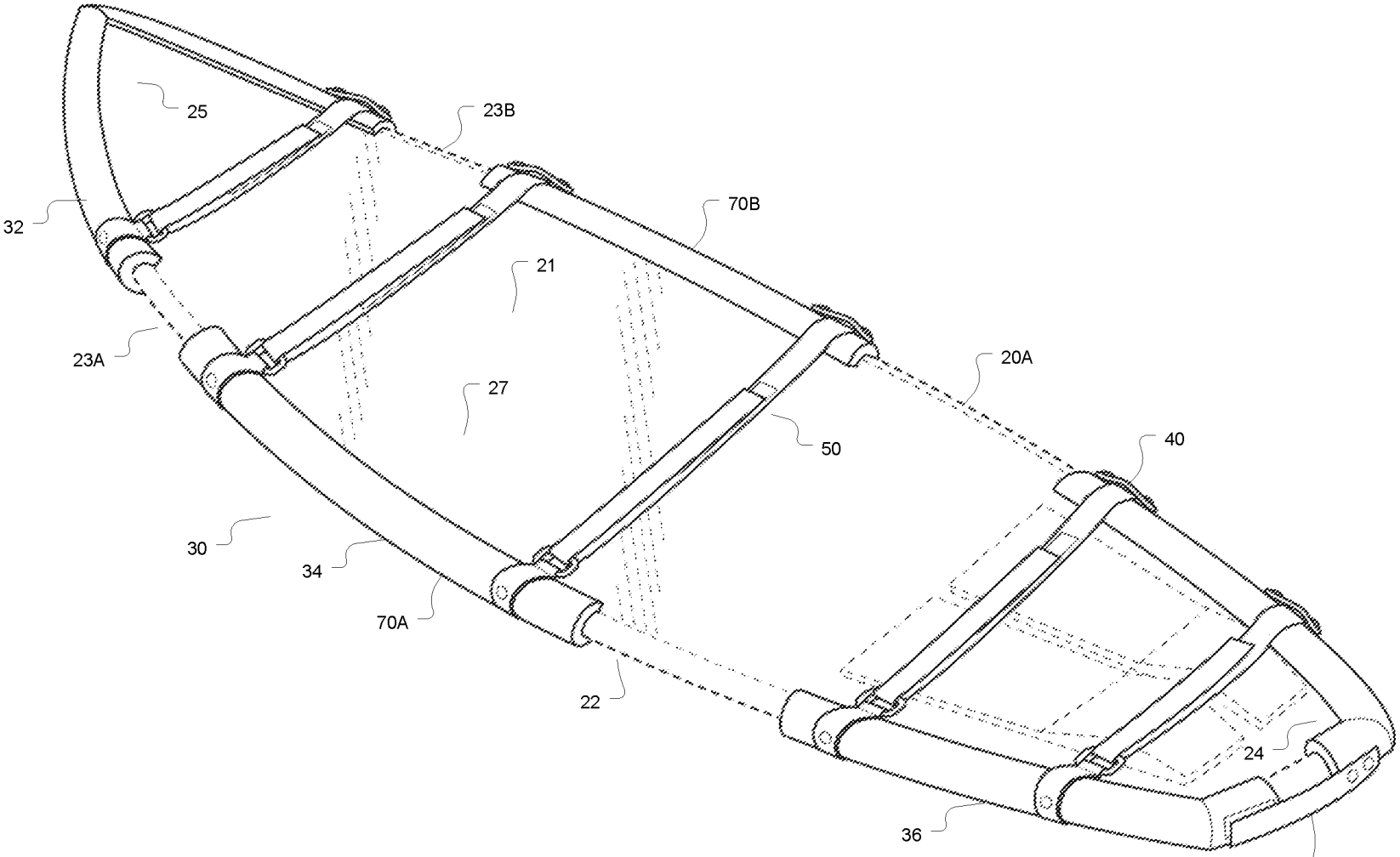
FIG. 1 is an isometric simplified diagram of a modular surfboard protection system (MSPS) coupled to a surfboard (shortboard) in accordance with an embodiment of the present invention.

Throughout this description, embodiments and variations are described for the purpose of illustrating uses and implementations of the invention. The illustrative description should be understood as presenting examples of the invention, rather than as limiting the scope of the invention.

A surfboard 20A, 20B commonly has deck 21, bottom 22, nose 25, a middle section (rocker) 27, tail 24, and rails 23A, 23B on both sides extending between the nose 25 and the tail 24. Surfboard are commonly made from a foam core covered with a fiberglass shell that forms the deck 21, bottom 22, and rails 23A, 23B. The fiberglass shell while rigid over larger section areas may be easily damaged (dinged) from force applied to small areas on the deck 21 and bottom 22 or force applied to the rails 23A, 23B. A protection system 10A, 10B, 10C may include sections 32, 34, 36 that protect areas of the rails 23A, 23B that may be more easily damaged and also provide vertical offsets (top and bottom) to the protect the deck 21 and bottom 22 in an embodiment. As a function of the shape of the rails and length of a surfboard, a protection system 10A-C may include two to five modular sections or three to four modular sections 32, 34, 36 in an embodiment.

Figure 2:
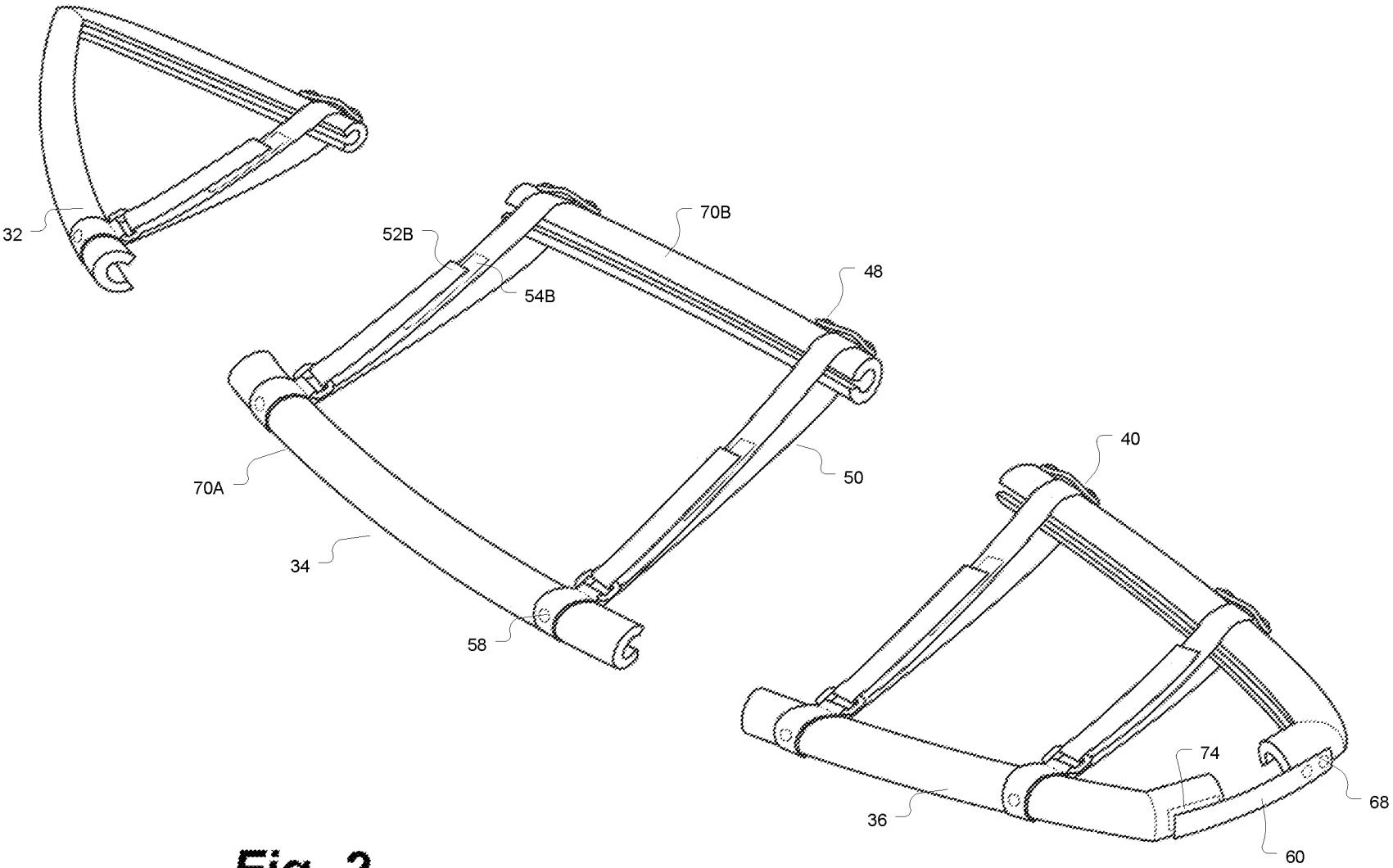
FIG. 2 is an isometric simplified diagram of the modular surfboard protection system (MSPS) shown in FIG. 1.

FIG. 1 is an isometric simplified diagram 10A of a modular surfboard protection system (MSPS) 30 coupled to a surfboard (shortboard) 20A in accordance with an embodiment of the present invention. FIG. 2 is an isometric simplified diagram of the modular surfboard protection system (MSPS) 30 shown in FIG. 1. As shown in FIGS. 1 and 2, the MSPS 30 may include three modular protection sections (MPS) 32, 34, and 36 coupled to the nose 25, rocker section 27, and tail 24 of a surfboard 20A. As also shown in FIG. 1, each MPS 32, 34, 36 may include at least a left bumper 70A and a right bumper 70B and at least one adjustable bumper coupling locking strap (ABCLS) 50.

Figure 3:
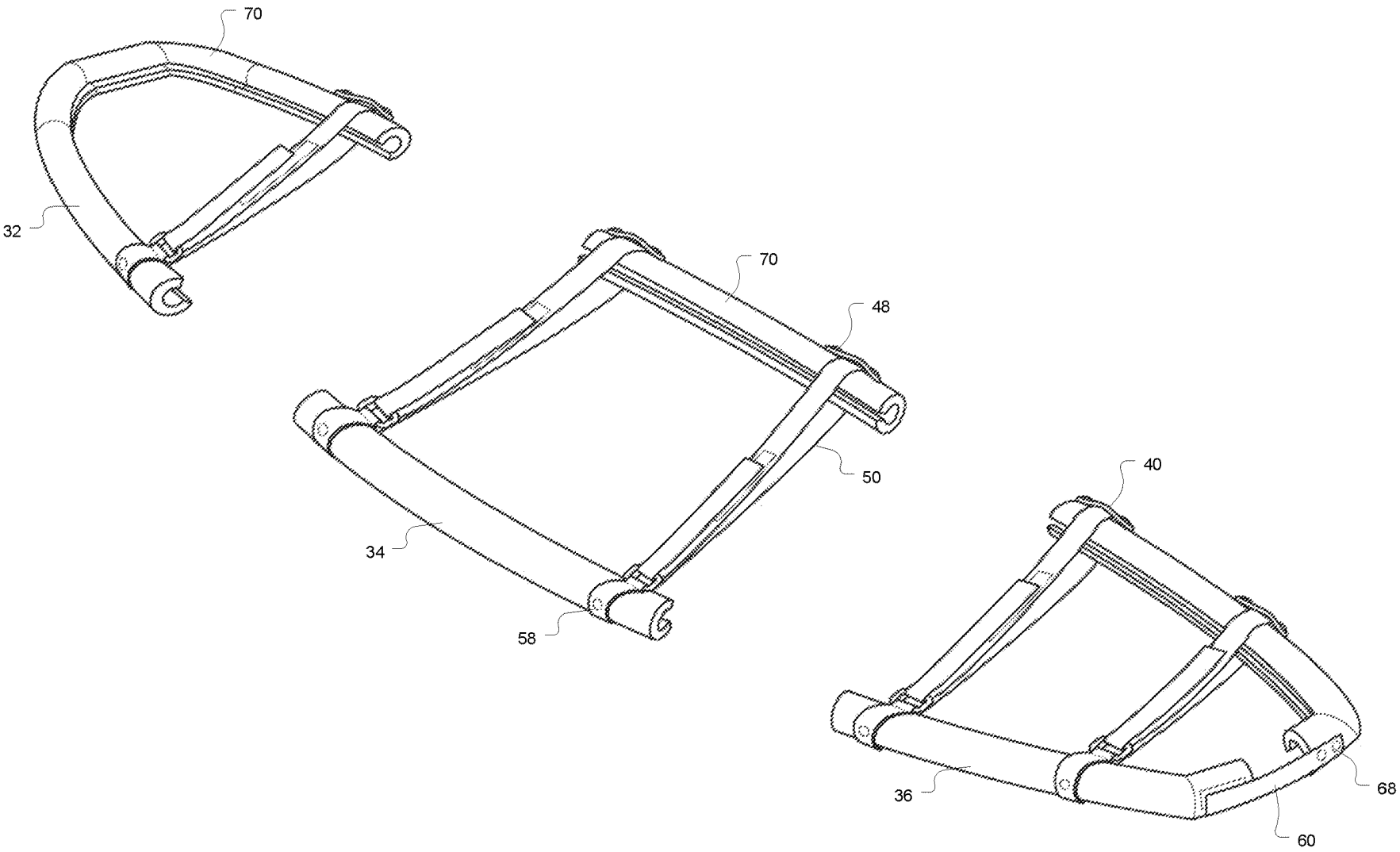
FIG. 3 is an isometric simplified diagram of the modular surfboard protection system (MSPS) for a different shaped surfboard in accordance with an embodiment of the present invention.

As shown in FIGS. 1 and 2, in each MPS 32, 34, and 36, a first end 52A (shown in FIG. 6C) of the ABCLS 50 may be securely coupled to a first bumper via a connector 58 and opening 57 in the ABCLS. A length 56 of the ABCLS 50 may be passed through a slot formed by a bumper routing strap (BRS) 40 shown in FIG. 6A coupled to an opposite bumper 70B via several connectors 48. As shown in FIGS. 2-3, the length 56 of a ABCLS 50 is sufficient to extend from a first bumper 70A around a second bumper 70B via the BRS 40 and through a buckle 54D coupled to the first end 52A and overlap at least a portion adjacent the first end 52A. FIG. 6C is a top view of an adjustable bumper coupling locking strap (ABCLS) 50 in accordance with an embodiment of the present invention. As shown in FIG. 6C, the ABCLS 50 may include a locking mechanism 54 having two sections or parts 54A, 54B. In an embodiment, the locking mechanism 54 enables the end 52B to be coupled to different areas of the ABCLS 50 to change the effective overall length of ABCLS 50 as a function of the width of a portion of a surfboard to be protected. In an embodiment, the locking mechanism 54 may include a first Velcro® part 54B having a shorter section and a second Velcro® part 54A having a longer section to enable locking the first part 54B to different sections of the first part 54A.

Figure 4:
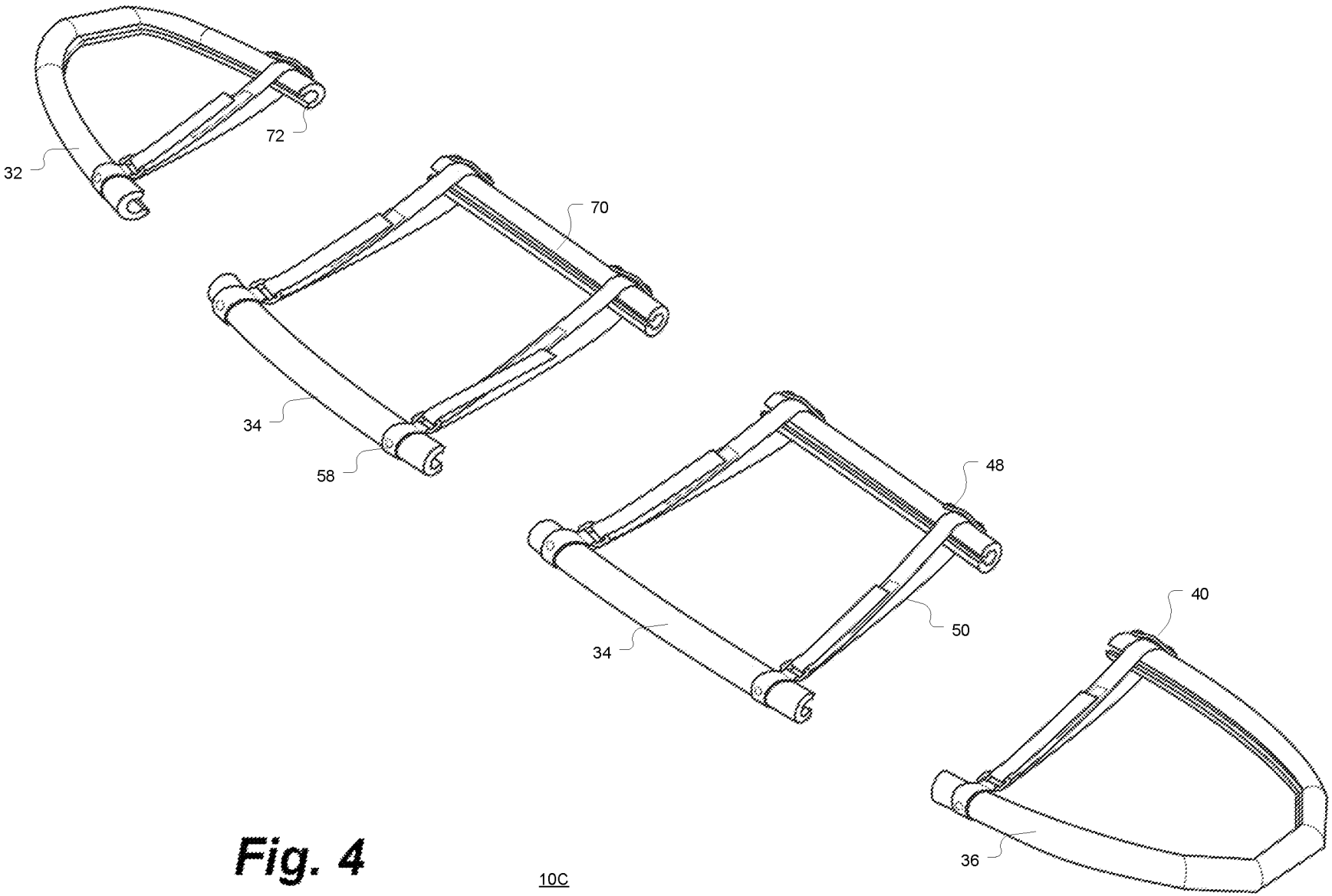
FIG. 4 is an isometric simplified diagram of the modular surfboard protection system (MSPS) for a longer surfboard (longboard) in accordance with an embodiment of the present invention.
Figure 6A:
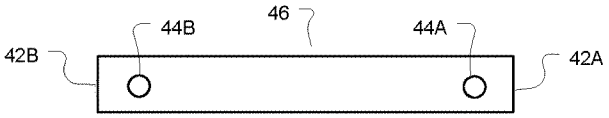
FIG. 6A is a top view of a bumper routing strap for a locking strap in accordance with an embodiment of the present invention.

FIG. 6A is a top view of a bummer routing strap (BRS) 40 in accordance with an embodiment of the present invention. As shown in FIG. 6A, the BRS 40 may have first end with an opening 44A and a second end 42B with an opening 44B with a length 46 therebetween at least greater than the width of the ABCLS 50 to enable the ABCLS 50 to pass therethrough. As shown in FIGS. 2-4, a BRS 40 may be coupled to a bumper 70B at two locations via the openings 44A, 44B. As shown in FIGS. 2-4, the nose modular section 32 may have bumpers 70A, 70B coupled together at an end and include a slot 72 having a width that enables the rails 23A, 23B to passed there into. A single ABCLS 50 may adjustably and securely couple the other ends of the bumpers 70A, 70B of the nose section 32.

Figure 6B:
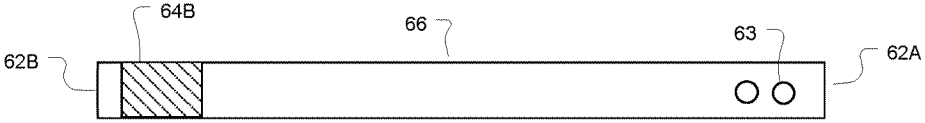
FIG. 6B is a top view of an adjustable bumper width strap in accordance with an embodiment of the present invention.
Figure 6C:
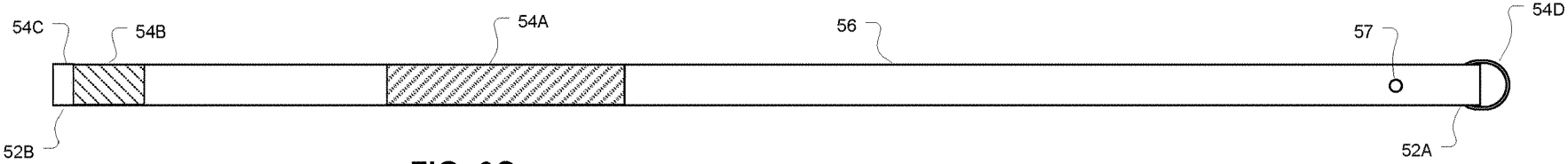
FIG. 6C is a top view of an adjustable bumper coupling locking strap in accordance with an embodiment of the present invention.

As shown in FIGS. 2-4, the rocker modular section 34 may also have bumpers 70A, 70B coupled together at both ends via a first and second ABCLS 50 that may adjustably and securely couple both ends of the bumpers 70A, 70B of the rocker section 34. As shown in FIGS. 2-3, a tail modular section 36 may also have bumpers 70A, 70B coupled together via a first and a second ABCLS 50 that may be adjustably secure parts of the bumpers 70A, 70B of the tail section 36. The tail section 36 shown in FIGS. 2-3 may have ends that are adjustably coupled in length via an adjustable bump width strap (ABWS) 60 shown in FIG. 6B. As shown in FIG. 6B, the ABWS 60 may have a first end 62B with a first section 64B of a locking mechanism 64 and a second end 62A with several openings 63 separated by a length 66. As shown in FIGS. 2 and 3, the second end 62A may be fixably coupled a first bumper 70B via connectors 68 and openings 63. The first end 62B may be adjustably coupled to the other bumper 70A via a second section 74 of a locking mechanism 64. In an embodiment, the locking mechanism 64 first section 64B may be a first Velcro® part and the second section 74 may be a second mating Velcro® part.

Figure 5:
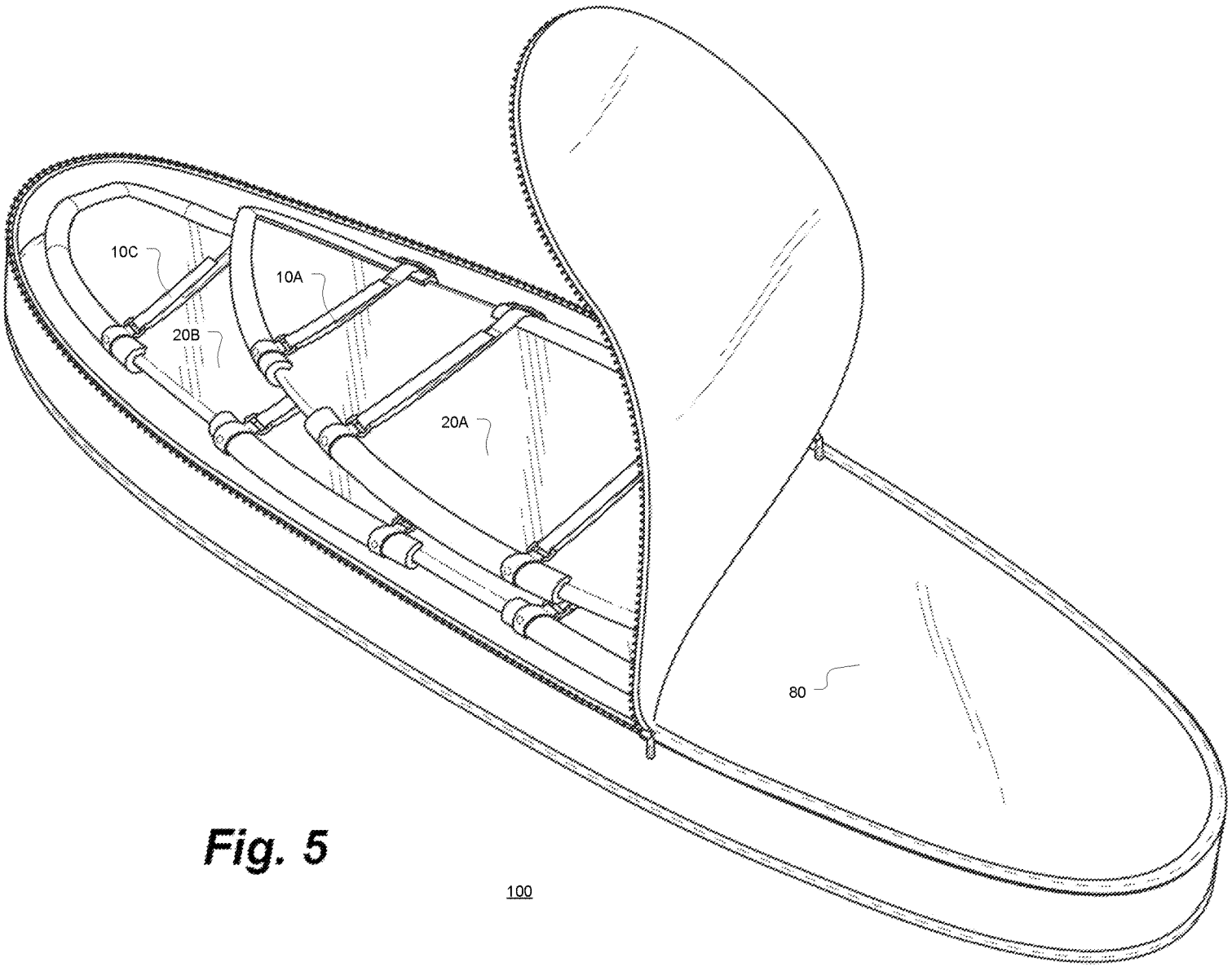
FIG. 5 is an isometric simplified diagram of several modular surfboard protection systems (MSPS) coupled to surfboards and stored in a bag in accordance with an embodiment of the present invention.

In an embodiment, a MSPS 30 shown in FIG. 4 may include multiple rocker sections 34 and a different tail section 36. As shown in FIG. 4, the tail section 36 may include a single ABCLS 50. The tail section 36 in FIG. 4 has first bumper 70A and second bumper 70B coupled together at their ends and shaped to engage a surfboard tail 24. FIG. 5 is an isometric simplified diagram 100 of several modular surfboard protection systems (MSPS) 10A, 10C coupled to surfboards 20A, 20B and stored in a bag 80 in accordance with an embodiment of the present invention. As shown in FIG. 5, the MSPS 10A, 10C vertically offset sections of the boards 20A, 20B (decks 21 and bottom 22) and protect the rails 23 while in the bag 80.

In an embodiment, a ABCLS 50, a BRS 40, and a ABWS 60 may be made of any flexible, strong materials including man-made and natural materials including polymers, metals, alloys, leather, and other materials and combinations thereof such as polyester. A locking strap 50 may have a width of about 0.2 to 2 inches and about 1 inch in an embodiment. A ABCLS 50, a BRS 40, and a ABWS 60 may have a thickness of about 0.05 to 0.4 inches and about 0.1 inches in an embodiment as a function of the materials that comprise the ABCLS 50, the BRS 40, and the ABWS 60. The ABCLS 50, the BRS 40, and the ABWS 60 may have various overall lengths as a function of the MSPS 30 where it is to be employed (width and length of the board 20A, 20B). In an embodiment, the first Velcro section 54B may have a length of about 0.5 to 2 inches and about 1 inch in an embodiment. The second Velcro section 54A may have a length of about 2 to 10 inches and about 8 inches in an embodiment. The distance between the Velcro® sections 54A, 54B may be about 2 to 15 inches and about 8 inches in an embodiment.

The bumpers 70A, 70B may be formed of any semi-rigid material such as a polymer including natural rubber and polyethylene foam in an embodiment. A bumper 70A, 70B may have a diameter of about 2 to 4 inches and about 3 inches in an embodiment. The length of bumper 70A, 70B may vary based on the section 32, 34, 36 and size of surfboard 20A, 20B to be protected and be about 12 to 50 inches in length in an embodiment.

While this invention has been described in terms of a best mode for achieving the objectives of the invention, it will be appreciated by those skilled in the art that variations may be accomplished in view of these teachings without deviating from the spirit or scope of the present invention. For example, the ABCLS 50, the BRS 40, and the ABWS 60 may be elastic or have elastic sections in an embodiment and may not have locking sections.

What is claimed is:

1. A modular surfboard protection system (MSPS) for a surfboard including a deck, bottom, tail, nose, and a left rail and a right rail between the nose and tail, the system including:

a modular nose protection section; and a modular tail protection section, wherein each section includes an elongated left bumper configured to engage the left rail adjacent the respective section and an elongated right bumper configured to engage the right rail adjacent the respective section and an adjustable bumper coupling locking strap (ABCLS) securely and adjustably coupling the left bumper to the right bumper to respective rails.

2. The MSPS of claim 1, further including a modular rocker protection section.

3. The MSPS of claim 1, wherein the modular nose protection section and the modular tail section are configurable for surfboards having different shapes and lengths.

4. The MSPS of claim 2, wherein the modular nose protection section, the modular tail section, and the modular rocker protection section are configurable for surfboards having different shapes and lengths.

5. The MSPS of claim 1, wherein the bumpers are configured to one of rest and be seated along rails of each section.

6. The MSPS of claim 1, wherein the bumpers include a slot sized to enable the rails of each section to be seated in the bumpers.

7. The MSPS of claim 1, wherein a first end of the ABCLS is permanently secured to one of the left bumper and the right bumper.

8. The MSPS of claim 7, wherein the other second end of the ABCLS is configured to pass about to the other of the left bumper and the right bumper.

9. The MSPS of claim 8, wherein second end of the ABCLS is slidably couplable to the first end of the ABCLS.

10. The MSPS of claim 9, wherein the second end of the ABCLS is includes a first segment of a securing system.

11. The MSPS of claim 10, wherein first end of the locking element includes a second segment of a securing system.

12. The MSPS of claim 11, wherein the first segment of a securing system includes first Velcro® element.

13. The MSPS of claim 12, wherein the second segment of a securing system includes a second Velcro® element mateable to the first Velcro® element.

14. The MSPS of claim 1, wherein the bumpers are formed of polyethylene foam.

15. The MSPS of claim 14, wherein ABCLS is formed of polyester.

16. The MSPS of claim 14, wherein ABCLS has a width of about 2 inches.

17. The MSPS of claim 16, wherein ABCLS is about 0.1 inches thick.

* * * * *